United States Patent [19]

Hellsten et al.

[11] Patent Number: 4,828,687

[45] Date of Patent: May 9, 1989

[54] FROTH FLOTATION PROCESS AND COLLECTOR THEREFOR

[75] Inventors: Martin Hellsten, Ödsmål; Anders Klingberg, Henån, both of Sweden

[73] Assignee: Berol Kemi AB, Stenungsund, Sweden

[21] Appl. No.: 719,172

[22] Filed: Apr. 3, 1985

[51] Int. Cl.[4] ..... B03D 1/14

[52] U.S. Cl. ..... 209/166; 252/61

[58] Field of Search ..... 209/166, 167; 252/61

[56] References Cited

U.S. PATENT DOCUMENTS 4,070,276 1/1978 Broman et al. ..... 209/166

4,358,368 11/1982 Hellsten et al. ..... 209/167

*Primary Examiner*—Bernard Nozick

[57] ABSTRACT

A froth flotation process in which an amphoteric compound is used as a collector for oxide and salt type minerals. The amphoteric compound has the formula

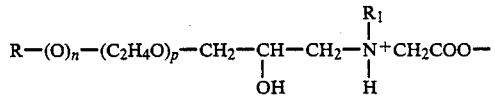

I in which R is a hydrocarbon group having 4 to 18 carbon atoms; n is 0 or 1; p is a number from 0 to 5; and $R_1$ is a hydrocarbon group having 5 to 18 carbon atoms or the group

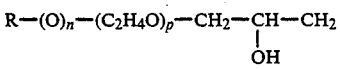

in which R, n and p have the above mentioned meaning; or a salt thereof.

6 Claims, No Drawings

FROTH FLOTATION PROCESS AND COLLECTOR THEREFOR

This invention relates to a froth flotation process in which an amphoteric compound is used as a collector. The collector has an excellent selectivity for oxide and salt type minerals such as phosphate, fluoride, copper, tungsten, niobium, and cobalt containing minerals.

In the U.S. Pat. No. 4,358,368 a froth flotation process is disclosed in which an amphoteric compound is used as a collector. The amphoteric compound has the general formula

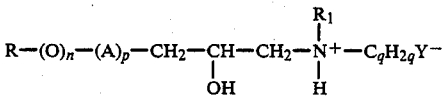

in which R is a hydrocarbon group having from about 7 to about 24 carbon atoms, and preferably from about 10 to about 18 carbon atoms; A is an oxyalkylene group having from 2 to about 4 carbon atoms; $R_1$ is selected from the group consisting of hydrogen and hydrocarbon groups having from 1 to about 4 carbon atoms; Y is selected from the group consisting of $COO^-$ and $SO_3^-$; n is a number from 0 to 1; p is a number from 0 to about 5; and q is a number from 1 to 2. This collector exhibits good selectivity for phosphate minerals and enriches the valuable minerals in high recoveries and high concentrations.

In accordance with the present invention it has been found that certain amphoteric compounds exhibit, in comparison with the prior art, considerably improved efficiency and selectivity as collector in a froth flotation process for oxide and salt type minerals such as phosphate, fluoride, copper, tungsten, niobium, and cobalt containing minerals. The amphoteric compounds of the invention have the general formula

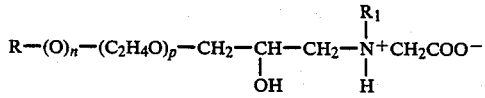

I in which R is a hydrocarbon group having 4 to 18 carbon atoms; n is 0 or 1; p is a number from 0 to 5; and $R_1$ is a hydrocarbon group having 5 to 18 carbon atoms or the group

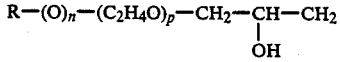

in which R, n and p have the above mentioned meaning; or a salt thereof.

Preferred compounds are those where R is a hydrocarbon group having 6 to 16 carbon atoms; p is a number from 0–2; and $R_1$ is a hydrocarbon group having 5 to 16 carbon atoms or the group

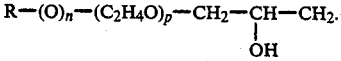

Especially preferred are compounds in which the total number of carbon atoms in the hydrocarbon groups of R and $R_1$ is 12 to 20. The number of carbon atoms of each hydrocarbon group in R and $R_1$ is preferably 6 to 10.

The compounds of the invention may easily be produced from commercially available starting compounds using known methods like the ones disclosed in the U.S. Pat. No. 4,358,368.

The group R may be derived from a hydroxyl compound. Examples of suitable hydroxyl compounds are Ziegler, Oxo and fatty alcohols such a butanol, isobutanol, secondary butanol, hexanol, secondary hexanol, iso-hexanol, 2-ethyl hexanol, octanol, lauryl alcohol, myristyl alcohol, cetyl alcohol, stearyl alcohol, and oleyl alcohol.

Besides aliphatic alcohols also cycloaliphatic alcohols and aromatic hydroxyl compounds may be utilized as starting product. Suitable cycloaliphatic alcohols are cyclohexanol and alkylsubstituted cycloalcohols. Of suitable aromatic hydroxyl compounds, synthetic manufactured mono- and dialkyl substituted phenols, such as octyl phenol, nonyl phenol, dodecyl phenol, dibutyl phenol ought above all to be emphasized.

When the group $R_1$ is a hydrocarbon group, it may be introduced by using an amino compound having the formula

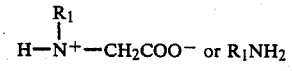

Those compounds in which $R_1$ is hexyl, octyl, decyl or an isomer thereof or phenyl are preferred.

The floating properties of the amphoteric compound could be further improved by performing the flotation process in the presence of a hydrophobic secondary collector, preferably in the form of a polar, water insoluble, hydrophobic substance, with affinity to the mineral particles coated with the amphoteric compound. The amphoteric compound is usually added in an amount of from 10 to 1000, preferably from 50 to 500 grams per metric ton of ore and the polar, water insoluble, hydrophobic substance in an amount from 0 to 1000, preferably from 5 to 750 grams per metric ton of ore. In the case the amphoteric compound is used in combination with the hydrophobic substance the weight ratio between them may be varied within wide limits but normally it is within the interval from 1:20 to 20:1, preferably from 1:5 to 5:1. The water insoluble hydrophobic substance, which according to the invention may be characterized as a secondary collector consists preferably of a polar substance. If desired, a conventional emulsifier could be dissolved in the hydrophobic secondary collector in order to obtain a stable emulsion in water and thereby an improved distribution.

The emulsifier may be a nonionic surface active compound, which in the case it is water insoluble is to be included in the polar substance. Suitable polar components are water insoluble soaps such as calcium soaps; water insoluble surface active alkylene oxide adducts; organic phosphate compounds, such as tributyl phosphate, tri(2-ethylhexyl)phosphate; and esters of carboxylic acids, such as tributyl ester and tri(2-ethyl hexyl)ester of NTA as well as dioctylphthalate.

In the froth flotation process of the invention the amphoteric collector could also with preference be utilized in combination with depressing agent. Suitable depressants are hydrophilic polysaccharides substituted with anionic groups. The polysaccharides having a relatively low viscosity are preferred. The molecular substitution may vary within wide limits but it is normally within the range from one anionic substituent per polysaccharide molecule to one substituent per hydroglucose unit. Example of suitable polysaccharides are carboxymethylcellulose, sulphomethylcellulose, gum arabic, karaya gum, tragacanth, gum ghatti, alginate and starch, such as corn starch and anionic starch derivatives such as carboxymethyl starch and starch phosphate.

In flotation using the present process pH-regulators may be added as well as depressants and activators in known manners. In most flotation processes the pH-value is of importance in obtaining a good separation. The flotation process of the invention is also dependent of the pH-value and this gives improved possibilities to optimize the separation of different minerals by the selection of a suitable pH-value. Thus, the character of the amphoteric compound varies considerably with the pH-value. At a pH-value below 6 it is mainly cationic, while it is chiefly anionic at pH-values above 10, and zwitterionic at a pH-value between 6 and 10. In the separation of ore containing apatite and silicate or apatite and calcite an excellent, selective enrichment is obtained, if the flotation process is carried out at a pH-value from about 8 to about 11. If considered convenient, conventional frothers, and activators could also be added. General rules are impossible to give in more detail, since each ore finally has to be treated in accordance with its own chemical and physical composition.

The compound and the process of the invention is further illustrated by the following Example.

EXAMPLE

An ore containing 10.3% by weight of fluoroapatite, 17.8% by weight of calcite, about 8% by weight of iron oxide minerals and a rest of silicate minerals was crushed into nuggets of less than 3 mm and homogenized. The homogenized material in an amount of 1.00 kg was ground for 10 minutes together with 0.8 l of water, 0.18 g sodium hydroxide and 0.50 g water glass of 38% by weight with a ratio $SiO_2/Na_2O$ of 3,3:1 to such a particle size that 80% by weight passed through a sieve of 350 um.

After grinding the pulp was transferred into a flotation cell having a capacity of 2 liters and diluted with water to a volume of 2 liters. A collector according to the Table I below was added in an amount of 0.065 g and the whole was conditioned for 5 minutes.

A rougher flotation was then carried out followed by four cleaning steps. During the whole flotation process the pH-value was kept constant by additions of sodium hydroxide. The results obtained are shown in Table II.

From the results it is evident that the tests 3–8 carried out in accordance with the invention give concentrates with considerably higher recoveries than the tests 1–2 carried out in accordance with the prior art.

TABLE I

COLLECTORS TESTED[1]

| Test | R | $R_1$ | n | p |
|---|---|---|---|---|
| 1 | $C_8$—alkyl | $CH_3$ | 1 | 0 |
| 2 | $C_{16}$—alkyl | $CH_3$ | 1 | 0 |
| 3 | $C_6$—alkyl | $C_6$—alkyl-O—$CH_2CH(OH)CH_2$ | 1 | 0 |
| 4 | $C_8$—alkyl | $C_8$—alkyl-O—$CH_2CH(OH)CH_2$ | 1 | 0 |
| 5 | $C_{10}$—alkyl | $C_6$—alkyl-O—$CH_2CH(OH)CH_2$ | 1 | 0 |
| 6 | $C_{12}$—alkyl | phenyl | 1 | 0 |
| 7 | $C_{16}$—alkyl | $C_5$—alkyl | 1 | 2 |
| 8 | $C_{15}$—alkyl | $C_5$—alkyl | 0 | 0 |

[1]The symbols R, $R_1$, n, and p, correspond to the symbols in the formula I.

TABLE II

RESULTS

| | Rougher Flotat. | | Cleaning 1 | | Cleaning 2 | | Cleaning 3 | | Cleaning 4 | |
|---|---|---|---|---|---|---|---|---|---|---|
| Test | Concentration % apatite | Recovery % apatite | Concentration % apatite | Recovery % apatite | Concentration % apatite | Recovery % apatite | Concentration % apatite | Recovery % apatite | Concentration % apatite | Recovery % apatite |
| 1 | 33.2 | 46.0 | 51.4 | 37.8 | 66.6 | 33.8 | 77.4 | 30.7 | 82.3 | 18.8 |
| 2 | 62.6 | 46.3 | 95.8 | 24.5 | —[1] | —[1] | 95.8 | 24.5 | —[1] | —[1] |
| 3 | 29.7 | 73.7 | 34.3 | 70.4 | 35.4 | 66.3 | 36.7 | 63.2 | 37.9 | 62.5 |
| 4 | 53.1 | 94.9 | 67.5 | 93.8 | 75.8 | 93.1 | 82.6 | 92.4 | 88.7 | 90.9 |
| 5 | 50.5 | 86.6 | 61.2 | 81.3 | 67.4 | 77.1 | 72.3 | 76.1 | 76.4 | 73.8 |
| 6 | 49.7 | 94.7 | 61.6 | 93.1 | 69.9 | 90.8 | 76.6 | 87.6 | 81.4 | 82.9 |
| 7 | 47.3 | 92.1 | 60.5 | 90.8 | —[1] | —[1] | —[1] | —[1] | —[1] | —[1] |
| 8 | 48.6 | 93.1 | 61.0 | 91.4 | —[1] | —[1] | —[1] | —[1] | —[1] | —[1] |

[1]not measured

We claim:

1. A process for froth flotation of fluorapatite calcite-iron oxide-silicate minerals in an aqueous flotation bath while preferentially and selectively floating the fluorapatite, which comprises carrying out the flotation in the presence of an amphoteric collector having the general formula:

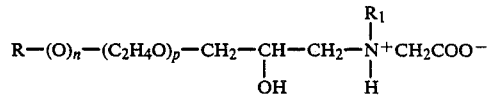

I in which R is alkyl having 4 to 18 carbon atoms; n is 0 or 1; p is a number from 0 to 2; and $R_1$ is the group

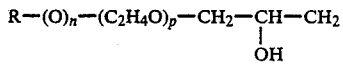

in which R, n and p have the above mentioned meaning; or a salt thereof.

2. Process in accordance with claim 1, characterized in that the total number of carbon atoms in the hydrocarbon groups of R and $R_1$ is 12–20.

3. Process in accordance with claim 1 or 2, characterized in that the amphoteric compound is added in an amount of 10—1000 grams per ton ore.

4. A process for froth flotation of fluorapatite calcite-iron oxide-silicate minerals in an aqueous flotation bath while preferentially and selectively floating the fluorapatite, which comprises carrying out the flotation in the presence of an amphoteric collector having the formula:

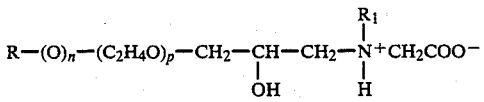

I in which R is alkyl having 12 carbon atoms; n is 1; p is 0; and $R_1$ is phenyl.

5. A process for froth flotation of fluorapatite calcite-iron oxide-silicate minerals in an aqueous flotation bath while preferentially and selectively floating the fluorapatite, which comprises carrying out the flotation in the presence of an amphoteric collector having the formula:

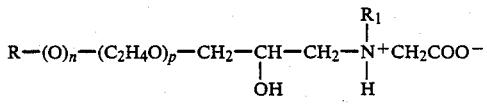

I in which R is alkyl having 16 carbon atoms; n is 1; p is 2; and $R_1$ is alkyl having 5 carbon atoms.

6. A process for froth flotation of fluorapatite calcite-iron oxide-silicate minerals in an aqueous flotation bath while preferentially and selectively floating the fluorapatite, which comprises carrying out the flotation in the presence of an amphoteric collector having the formula:

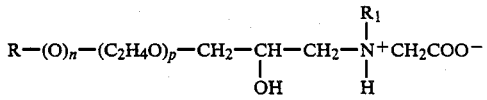

I in which R is alkyl having 15 carbon atoms; n is 0; p is 0; and $R_1$ is alkyl having 5 carbon atoms.

* * * * *